US005465545A

United States Patent [19]

Trousilek

[11] Patent Number: 5,465,545

[45] **Date of Patent: * Nov. 14, 1995**

[54] WALL STRUCTURE FABRICATING SYSTEM AND PREFABRICATED FORM FOR USE THEREIN

[76] Inventor: Jan P. V. Trousilek, 468 Purgatory Rd., Middletown, R.I. 02842

[ * ] Notice: The portion of the term of this patent subsequent to May 17, 2011, has been disclaimed.

[21] Appl. No.: 180,868

[22] Filed: Jan. 12, 1994

Related U.S. Application Data

[63] Continuation-in-part of Ser. No. 908,286, Jul. 2, 1992, Pat. No. 5,311,718.

[51] Int. Cl.[6] ..... E04B 2/00

[52] U.S. Cl. ..... 52/425; 52/421; 52/439; 52/436

[58] Field of Search ..... 52/80.5, 408, 410, 52/286, 293, 425, 442, 436, 439, 415, 421, 593, 595, 588, 586, 580

[56] References Cited

U.S. PATENT DOCUMENTS

| | | |
|---|---|---|
| 2,701,464 | 2/1955 | Kyle et al. . |
| 3,438,165 | 4/1969 | Morawski . |
| 3,440,785 | 4/1969 | Denny et al. . |
| 3,509,673 | 5/1970 | Witkosky et al. . |
| 3,668,832 | 6/1972 | Harman . |
| 3,780,481 | 12/1973 | Tomkins . |
| 3,782,049 | 1/1974 | Sachs . |
| 4,104,837 | 8/1978 | Naito . |
| 4,186,160 | 1/1980 | Landreth . |
| 4,299,070 | 11/1981 | Oltmanns et al. . |
| 4,438,614 | 3/1984 | Raith et al. . |
| 4,439,967 | 4/1984 | Dielenberg . |
| 4,532,745 | 8/1985 | Kinard . |
| 4,698,947 | 10/1987 | McKay . |
| 4,706,429 | 11/1987 | Young . |
| 4,731,968 | 3/1988 | Obino . |
| 4,860,515 | 8/1989 | Browning, Jr. . |
| 4,884,382 | 12/1989 | Horobin . |
| 4,889,310 | 12/1989 | Boeshart . |
| 4,894,969 | 1/1990 | Horobin . |
| 5,014,476 | 5/1991 | Leslie et al. . |
| 5,014,478 | 5/1991 | Spring . |
| 5,014,480 | 5/1991 | Guarriello et al. . |
| 5,038,541 | 8/1991 | Gibbar, Jr. . |
| 5,040,344 | 8/1991 | Durand . |

FOREIGN PATENT DOCUMENTS

| | | |
|---|---|---|
| 6027 | 5/1986 | United Kingdom . |

*Primary Examiner*—Carl D. Friedman
*Assistant Examiner*—Beth A. Aubrey
*Attorney, Agent, or Firm*—Kriegsman & Kriegsman

[57] ABSTRACT

A multi-component modular system for use in fabricating wall structures of the type which may be fortified with concrete or other similar materials. The system includes in one embodiment a plurality of identical prefabricated forms, each form comprising an elongated, generally rectangular plastic member having a cavity defined by a pair of side panels and a pair of end panels. One end panel has a pair of opposed, outwardly-facing, L-shaped flanges, and the other end panel has a pair of opposed, inwardly-facing slots sized and shaped to matingly receive the L-shaped flanges. Two or more forms may be interconnected in an end-to-end fashion by inserting the L-shaped flanges of one form into the L-shaped slots of a second form. A plurality of holes are provided on the end panels of the forms to permit concrete to be distributed monolithically between adjacent forms and to accommodate the placement of horizontal reinforcement bars. The system also includes left end members and right end members mateable with the left end and right end panels, respectively, of a form to contain the flow of concrete out of the ends of a form and/or to join together a pair of forms in an end-to-side relationship (i.e. to make perpendicular walls), supporting strut members mountable transversely within forms, and divider panels for use in partitioning form cavities into concrete-receiving spaces and insulation spaces.

20 Claims, 17 Drawing Sheets

WALL STRUCTURE FABRICATING SYSTEM AND PREFABRICATED FORM FOR USE THEREIN

The present application is a continuation-in-part of U.S. patent application Ser. No. 07/908,286, filed Jul. 2, 1992, now U.S. Pat. No. 5,311,718.

BACKGROUND OF THE INVENTION

The present invention relates generally to prefabricated forms and to wall structure fabrication systems employing said forms and more particularly to a new and improved wall structure fabrication system including a novel prefabricated form.

It is well-recognized that millions of people, both in the United States and abroad, lack some form of minimally-acceptable dwelling wherein refuge from both natural and man-made elements may be sought. Most often, this is because the costs associated with obtaining a structurally-sound dwelling, e.g., the cost of obtaining suitable building materials and the cost of employing skilled labor to fashion a building using such building materials, arc prohibitive. For example, the typical manner of fabricating concrete walls for a dwelling is clearly rather complex and time-consuming as it requires both the strategic placement of steel bracings, wood form boards, and extensive exterior bracing to hold the form boards in the appropriate alignment while concrete is poured between the wood form boards and the subsequent removal of the wood form boards and exterior bracing once the concrete has been poured and allowed to harden into a wall.

Recently, a multitude of novel wall-forming systems have come into being, the systems making use of a plurality of hollow interconnected plastic forms into which concrete may be poured. After concrete is poured into the forms and allowed to harden, the forms remain in place to serve as insulation. Examples of patents relating to these types of wall-forming systems are described below.

U.S. Pat. No. 5,038,541, to Gibbar, Jr., which issued Aug. 13, 1991, relates to a polymer building wall form construction. The construction comprises forms prefabricated of a polymer, such as polystyrene, which are assembled together, the forms being spaced apart by integrally connecting polymers or blocks, spacers, or spool means, erected upon a foundation footing, or other base structure, through their insertion of L-shaped ties, with the wall forms being erected to the height desired for the subject building or other structure, whether it be a commercial, industrial, or residential building, through the application of tee-shaped ties therebetween. Reinforcement is located in the spacing between the blocks or spacers, of the wall forms, and concrete may be poured therein, either at the job site, where the building is being constructed, or at the manufacturing plant, where the wall forms are formed, in order to provide a latticework of reinforced concrete for the composite wall. The internal surface of each of the inner and outer liners forming the wall form are shaped into the configuration of an I-beam in order that any concrete poured therein will undertake the cross-sectional configuration of an I-beam to add further reinforcement to the fabricated building, once a wall is completed. A top beam form of plate cap is arranged upon the upper edge of the formed wall, with the concrete being poured simultaneously with the construction of the assembled wall. Bracing held together by ties and locked into position by fasteners secures the wall forms together, in their erected disposition, in preparation for the pouring of the latticework of concrete reinforced composite wall.

U.S. Pat. No. 5,014,480 to Guarriello et al., which issued May 14, 1991, relates to hollow foamed plastic forms for poured concrete. Each of the forms has a pair of opposed parallel side walls with planar upper and lower faces, and a pair of opposed end members. Disposed on the upper and lower faces of the side walls are a series of elongated locking members, each composed of a pair of offset ribs having a trapezoidal shape.

U.S. Pat. No. 4,894,969 to Horobin, which issued Jan. 23, 1990, relates to an insulating block form for constructing concrete wall structures. The block form is formed from expandable polystyrene material to provide a lightweight, rigid, box-like structure having a pair of oppositely disposed side walls and end walls which together define a body cavity to receive concrete therein. A plurality of transverse strut members integrally support the side walls and further define a plurality of cells. Each end wall includes a pair of inserts which are adapted to be mounted to the transverse strut member when the elongated block form is required to be cut for a particular installation. The side and end walls are further provided with interlocking members whereby they are readily stacked one above the other and side-to-side in a secure interlocked arrangement.

U.S. Pat. No. 4,884,382 to Horobin, which issued Dec. 5, 1989, relates to a modular building-block form. The form is shaped in a rectangular configuration and has a pair of oppositely disposed side panel members and end enclosure panels to define a body cavity to receive poured concrete therein. The side panels are held in a fixed parallel relation to each other and are further prevented from side-to-side movement relative to each other by a plurality of strut members which are fixedly mounted transversely from one side panel to the other. Each strut member is formed with substantially "H"-shaped tenon members that are slidably engaged with spaced-apart, "T"-shaped slots formed in the inner surfaces of said side panels. The panel structure is firmly grasped within the pair of opposed stud members that define the tenons. The tenons are integrally connected together by means of truss members that further define passages therethrough for flow of wet concrete therebetween.

Other patents of interest include U.S. Pat. No. 4,438,614 to Raith et al., which issued Mar. 27, 1984; U.S. Pat. No. 4,186,160 to Landreth, which issued Jan. 29, 1980; U.S. Pat. No. 5,040,344 to Durand, which issued Aug. 20, 1991; U.S. Pat. No. 5,014,478 to Spring, which issued May 14, 1991; U.S. Pat. No. 5,014,476 to Leslie et al., which issued May 14, 1991; U.S. Pat. No. 4,889,310 to Boeshart, which issued Dec. 26, 1989; U.S. Pat. No. 4,860,515 to Browning, Jr., which issued Aug. 29, 1989; U.S. Pat. No. 4,731,968 to Obino, which issued Mar. 22, 1988; U.S. Pat. No. 4,706,429 to Young, which issued Nov. 17, 1987; U.S. Pat. No. 4,698,947 to McKay, which issued Oct. 13, 1987; U.S. Pat. No. 4,532,745 to Kinard, which issued Aug. 6, 1985; U.S. Pat. No. 4,299,070 to Oltmanns et al., which issued Nov. 10, 1981; U.S. Pat. No. 3,782,049 to Sachs, which issued Jan. 1, 1974; U.S. Pat. No. 3,668,832 to Harman, which issued Jun. 13, 1972; U.S. Pat. No. 3,509,673 to Witkosky et al., which issued May 5, 1970; U.S. Pat. No. 3,440,785 to Denny et al., which issued Apr. 29, 1969; and U.S. Pat. No. 3,438,165 to Morawski, which issued Apr. 15, 1969.

SUMMARY OF THE INVENTION

It is an object of the present invention to provide a novel wall structure fabrication system.

It is another object of the present invention to provide a wall structure fabrication system as described above which can be used easily and quickly by unskilled labor.

It is still another object of the present invention to provide a wall structure fabrication system as described above the components of which may be made of durable yet inexpensive materials.

It is still yet another object of the present invention to provide a wall structure fabrication system as described above which can be used to fabricate various types of wall structures for use in various types of settings, e.g. urban settings vs. rural settings, temperate climates vs. cold climates.

Additional objects, as well as features and advantages, of the present invention will be set forth in part in the description which follows, and in part will be obvious from the description or may be learned by practice of the invention. The objects, features, and advantages of the present invention may be realized and attained by means of the instrumentalities and combinations particularly pointed out in the appended claims.

The wall structure fabrication system of the present invention comprises in one preferred embodiment a prefabricated form, the form comprising an elongated, rectangularly-shaped member defined by a right end panel, a left end panel, and a pair of side panels. The right end panel is shaped to include a pair of L-shaped flanges extending outwardly therefrom and facing away from one another, and the left end panel is shaped to include a pair of L-shaped slots shaped so as to mate with said pair of L-shaped flanges. The right end panel; left end panel, and pair of side panels together define a cavity into which concrete or other filler material may be poured. One or more openings are formed on the right and left ends of the prefabricated form so that concrete or the like can be distributed monolithically between adjacent forms and to accommodate, if desired, the placement of steel reinforcement bars or the like through adjacent forms. Two or more of said prefabricated forms may be interconnected in an end-to-end relationship to form a wall structure by inserting the pair of L-shaped flanges on the left end panel of one of said prefabricated forms into the pair of L-shaped slots on the right end panel of an adjacent prefabricated form.

The aforementioned wall structure fabrication system also includes a number of auxiliary components which may be used in conjunction with the above-described form. These auxiliary components include a strut member which is adapted to be mounted transversely across the form for providing lateral support to the side panels, a divider panel which is adapted to be mounted longitudinally within the form for dividing the cavity into (a) a space into which concrete or other filler materials may be poured and (b) an insulation space, a right end member mateable with the right end panel of the form for use in containing the flow of concrete out of the openings formed in the right end panel and/or for use in joining the right end panel of one form to a side panel of a second form (for use in making perpendicularly extending wall structures), a left end member mateable with the left end panel of the form for use in containing the flow of concrete out of the openings formed in the left end panel and/or for use in joining the left end panel of one form to a side panel of a second form (also for use in making perpendicularly extending wall structures), and a U-shaped bracket which may be used, in conjunction with specially dimensioned prefabricated forms, to define door frames, window frames or the like, and/or which may be used in other applications to be described below.

In other preferred embodiments of the present invention, the wall structure fabrication system includes prefabricated forms which differ in construction from the above-described prefabricated form and may include different auxiliary components.

As will be explained below in greater detail, the wall structure fabrication system of the present invention can be used to construct entire dwellings and other similarly roofed building structures. Such roofed structures and the method of constructing same using the present wall structure fabrication system are also considered to form a part of the present invention.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

The present invention relates to a novel wall structure fabrication system comprising a variety of modular components which, as will hereinafter be seen, may be assembled in various ways to provide different types of wall structures.

Figure 1:
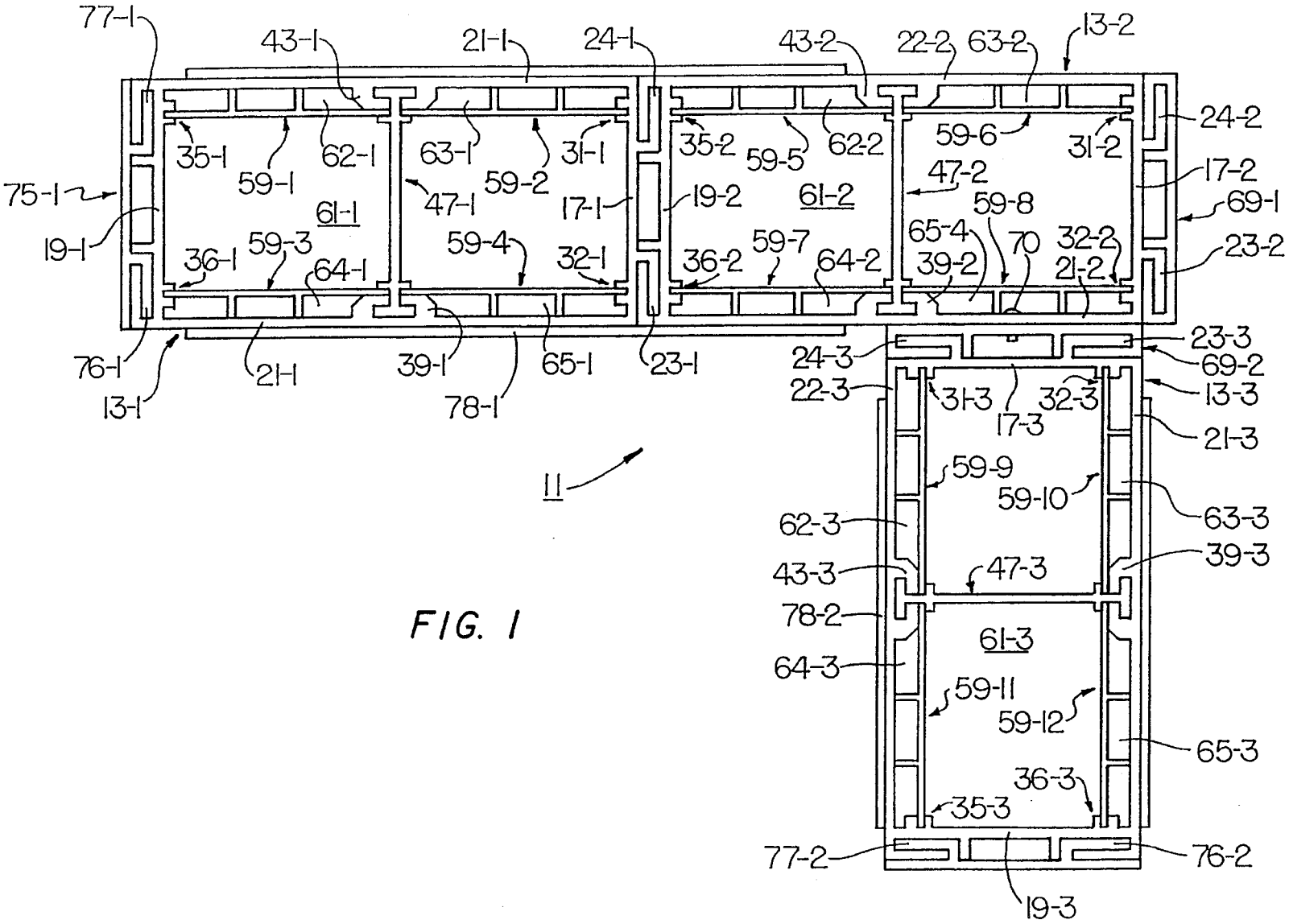
FIG. 1 is a top view of a simple wall structure fabricated using a first embodiment of the wall structure fabrication system of the present invention.

Referring now to FIG. 1, there is shown a simple wall structure fabricated using selected components of one embodiment of the wall structure fabrication system of the present invention, the wall structure being represented generally by reference numeral 11, the particular wall structure shown being for illustrative purposes only.

Figure 2:
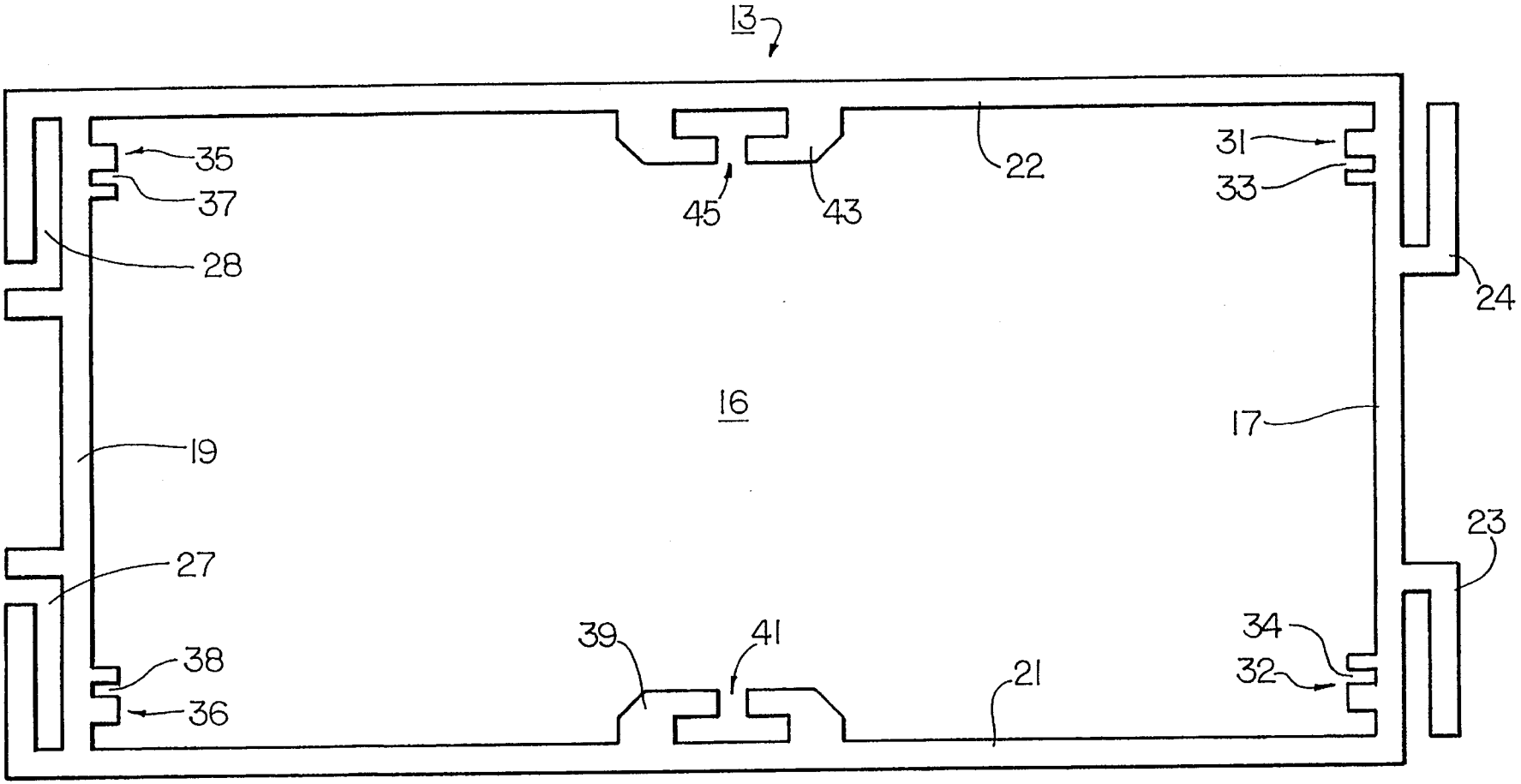
FIG. 2 is a top view of one of the prefabricated forms shown in FIG. 1.
Figure 3B:
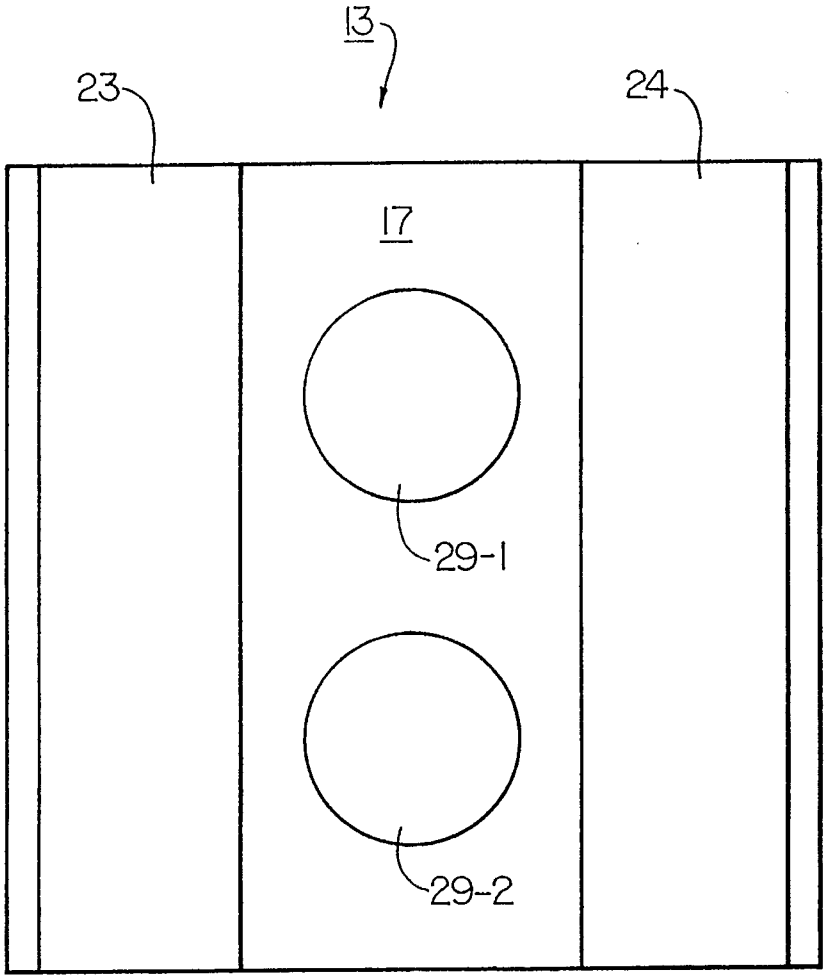
FIGS. 3(*a*) and 3(*b*) are left end and right end views, respectively, of the prefabricated form shown in FIG. 2.
Figure 3A:
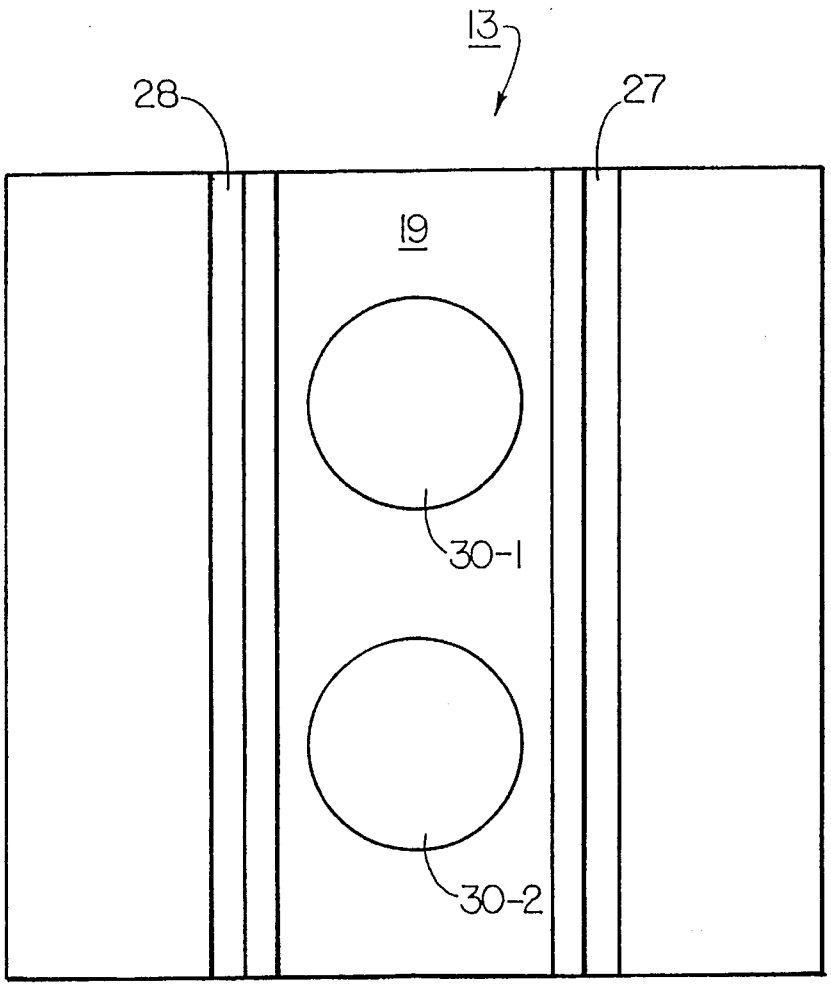

Wall structure 11 includes a plurality of prefabricated forms 13-1 through 13-3. An exemplary form 13 is shown separately in FIGS. 2 and 3. As can be seen, form 13 is an elongated, generally rectangular, unitary structure having a hollow cavity 16 adapted to receive concrete, sand, mud, gravel, or other similar materials, cavity 16 being defined by a right end panel 17, a left end panel 19, and a pair of side panels 21 and 22. The outer surface of right end panel 17 is shaped to include a pair of opposed, outwardly facing, L-shaped flanges 23 and 24, and the outer surface of left end panel 19 is shaped to include a pair of L-shaped slots 27 and 28. Slots 27 and 28 are sized and shaped to mate with flanges 23 and 24, respectively, so that a pair of forms 13 may be interconnected in an end-to-end relationship by inserting flanges 23 and 24 of one form 13 into slots 27 and 28, respectively, of a second form 13.

In addition, right end panel 17 is shaped to include a pair of openings 29-1 and 29-2, which are located between flanges 23 and 24 and through which concrete or other similar materials may pass. Left end panel 19 is similarly shaped to include a pair of openings 30-1 and 30-2, which are located between slots 27 and 28 and are used for a similar purpose. Openings 29 and 30 of end panels 17 and 19, respectively, are alignable so that, when a pair of forms 13 are interconnected in an end-to-end relationship and concrete or other similar materials are poured into the forms, the materials are permitted to pass between adjacent forms 13 in such a way as to provide a monolithic structure. In addition to being useful in the formation of monolithic structures between adjacent forms, openings 29 and 30 also permit structural reinforcement bars to be inserted through adjacent forms 13.

The inner surface of end panel 17 is shaped to include a pair of embossments 31 and 32, which extend vertically downward from the top surface of end panel 17 to the bottom surface thereof. Embossments 31 and 32 are provided with longitudinally-extending slots 33 and 34, respectively, each of which is adapted to receive one end of a divider panel to be hereinafter described. The inner surface of end panel 19 is a mirror image of that of end panel 17; consequently, it also includes a pair of embossments 35 and 36, which are provided with slots 37 and 38, respectively, each of which is adapted to receive one end of a divider panel.

The inner surface of side panel 21 is shaped to include an embossment 39, which extends vertically downward from the top surface of side panel 21 to the bottom surface thereof. Embossment 39 is shaped to include a longitudinally-extending, T-shaped slot 41. As will be discussed below in greater detail, slot 41 is adapted to receive one end of a strut member to be hereinafter described. The inner surface of side panel 22 is a mirror image of that of side panel 21; consequently, it also includes an embossment 43 having a T-shaped slot 45, slot 45 being adapted to receive the opposite end of a strut member.

Figure 4:
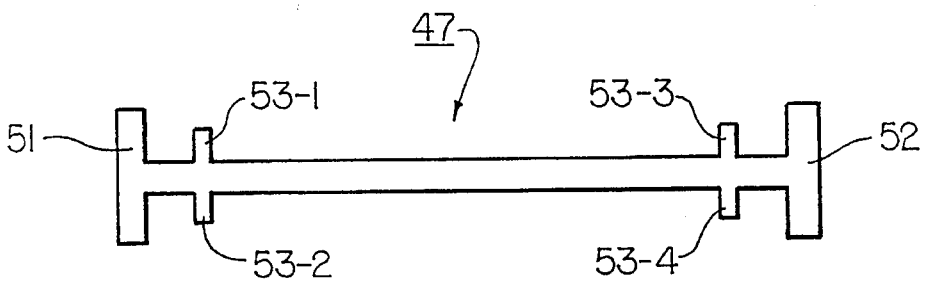
FIG. 4 is a top view of one of the strut members shown in FIG. 1.
Figure 5:
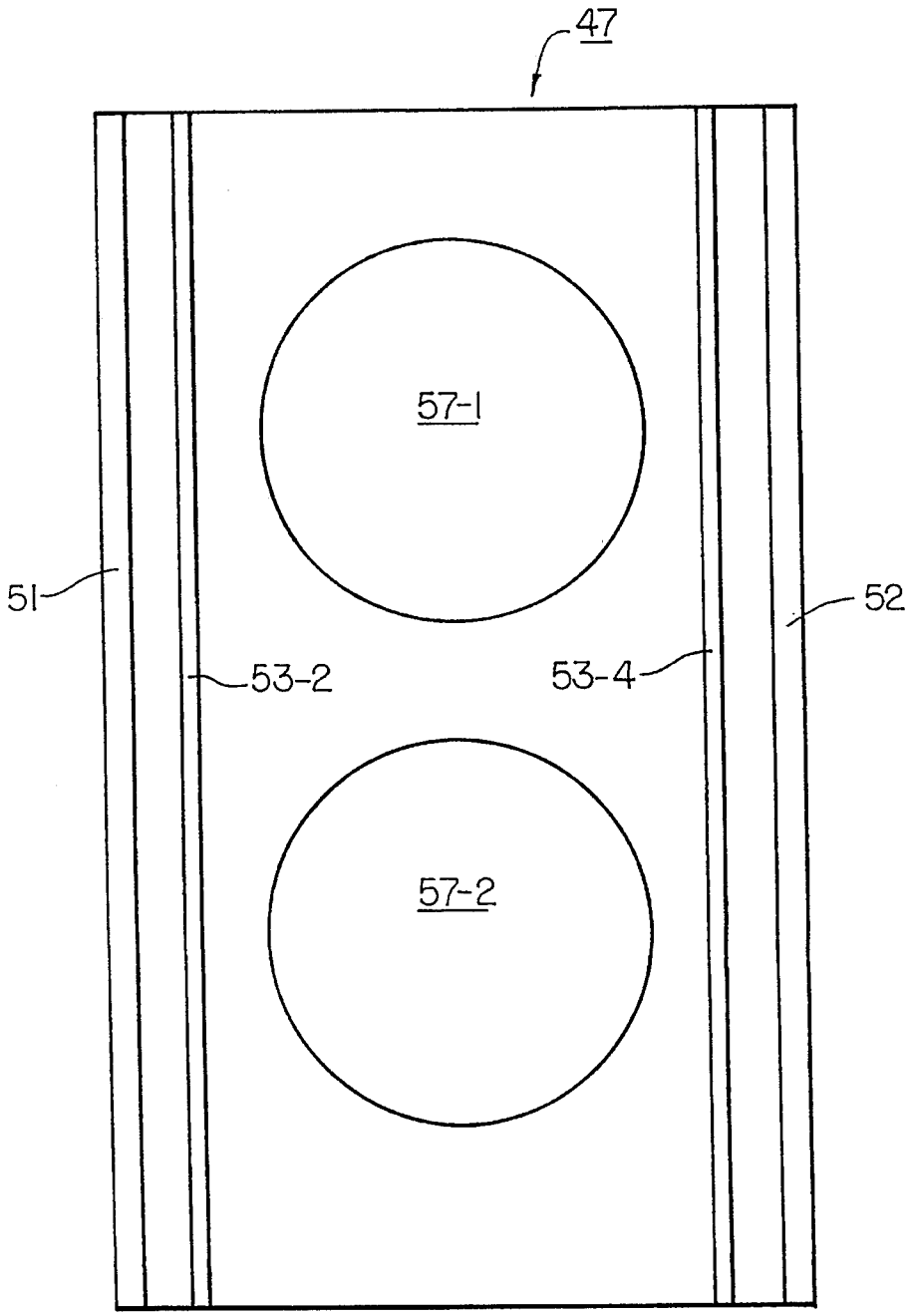
FIG. 5 is a right side view of the strut member shown in FIG. 4.

Referring back to FIG. 1, wall structure 11 can also be seen to include a plurality of strut members 47-1 through 47-3, which are transversely mounted within forms 13-1 through 13-3, respectively. An exemplary strut member 47 is shown separately in FIGS. 4 and 5. As can be seen, strut member 47 is an elongated, generally rectangular, unitary structure having a pair of T-shaped ends 51 and 52, which extend downwardly the entire vertical length of member 47. T-shaped ends 51 and 52 are mateable with slots 41 and 45, respectively, and are used to interconnect strut member 47 to side panels 21 and 22 of form 13. Strut member 47, when thus connected to form 13, serves to keep side panels 21 and 22 from spreading apart, which they might otherwise be inclined to do when concrete or the like is poured into form 13.

Figure 6:
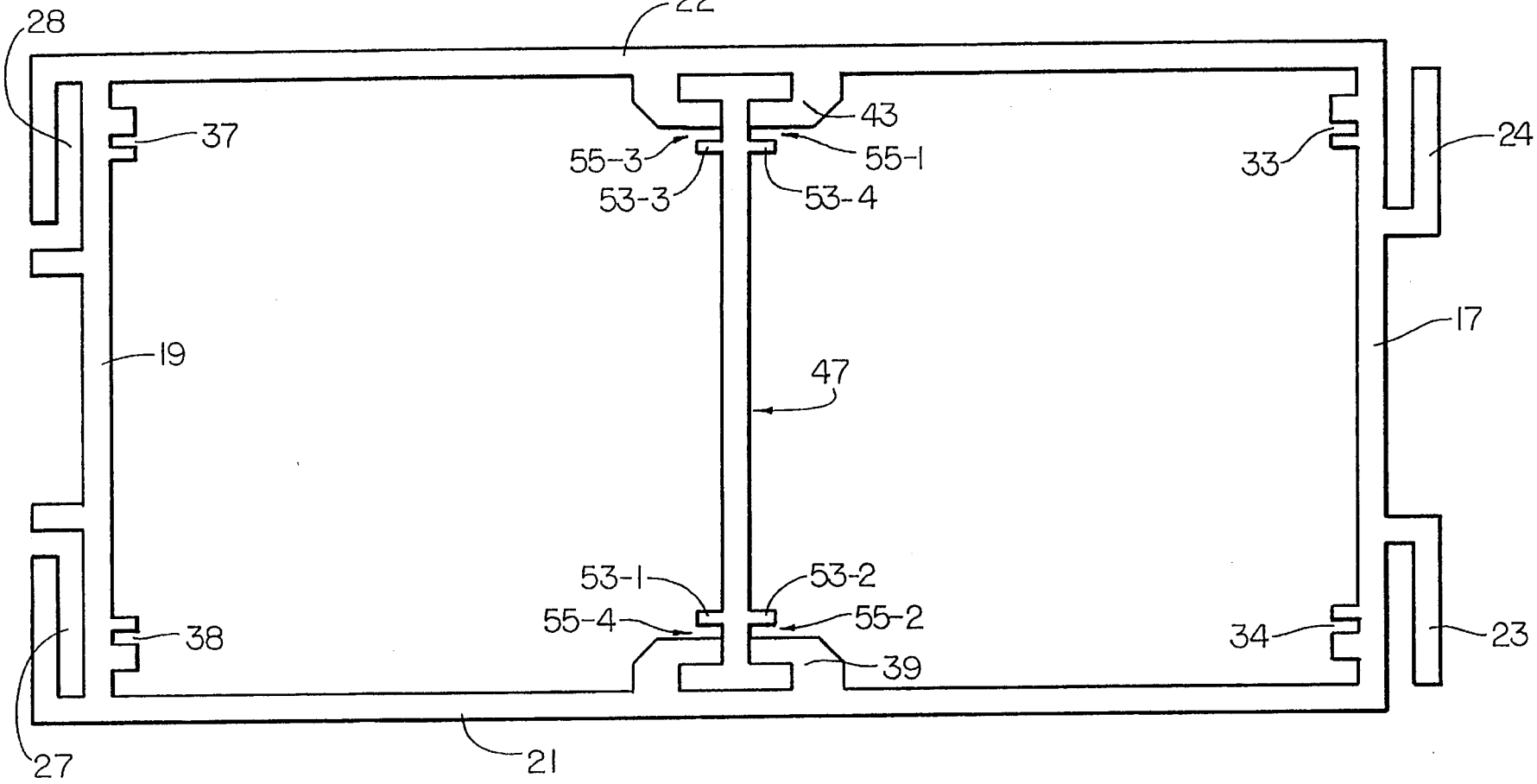
FIG. 6 is a top view of one of the prefabricated forms of FIG. 1 and one of the strut members of FIG. 1 shown in their assembled form.

Strut member 47 is also shaped to include a plurality of slats 53-1 through 53-4, which extend downardly the entire vertical length of member 47. Slats 53-1 through 53-4 are appropriately spaced inwardly from ends 51 and 52 so that, when strut member 47 is transversely mounted within form 13, a plurality of slots 55-1 through 55-4 (see FIG. 6) are defined by slats 53-1 through 53-4 and embossments 39 and 43. Slots 55-1 through 55-4 are aligned with slots 33, 34, 37, and 38, respectively, and are adapted to receive the opposite ends of divider panels having one end mounted within slots 33, 34, 37 and 38. So as not to obstruct the flow of concrete or other similar materials poured into form 13, a pair of openings 57-1 and 57-2 are provided in the side of member 47 between slats 53.

Figure 7:
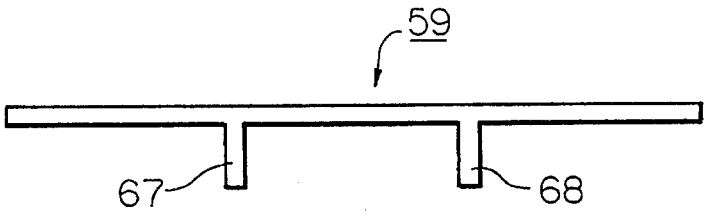
FIG. 7 is a top view of one of the divider panels shown in FIG. 1.
Figure 8:
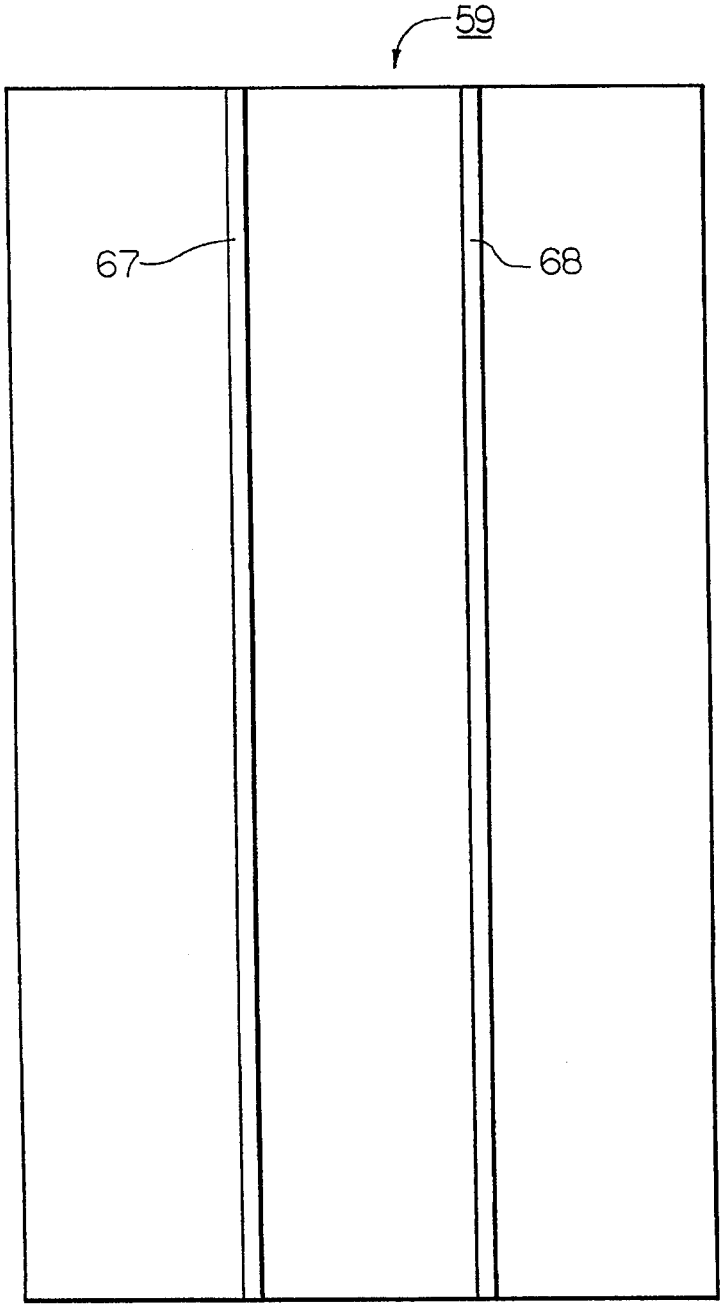
FIG. 8 is a rear view of the divider panel shown in FIG. 7.

Referring back again to FIG. 1, wall structure 11 can further be seen to include a plurality of divider panels 59-1 through 59-12, panels 59-1 through 59-4 being mounted in form 13-1, panels 59-5 through 59-8 being mounted in form 13-2, and panels 59-9 through 59-12 being mounted in form 13-3. As can be seen, divider panels 59 can be used, if desired, to partition cavity 16 of form 13 into a smaller space 61 adapted to receive concrete, sand, mud, gravel, or the like, and a plurality of air spaces 62 through 65, which may be used for insulation. An exemplary divider panel 59 is shown in FIGS. 7 and 8. As can be seen, divider panel 59 is an elongated, generally rectangular, unitary structure having a pair of slats 67 and 68, which extend downwardly the entire vertical length of panel 59 on one side thereof. Slats 67 and 68 are made to extend sufficiently outwardly so that, when panel 59 is mounted in form 13, the inner surface of side panel 21 or 22 is engaged thereby. In this way, panel 59 is kept from being bent outwardly due to the weight of concrete or the like poured into space 61. Similarly, slats 67 and 68 provide support to side panels 21 and 22 to keep them from being pushed inwardly by an external force directed thereto.

Figure 9:
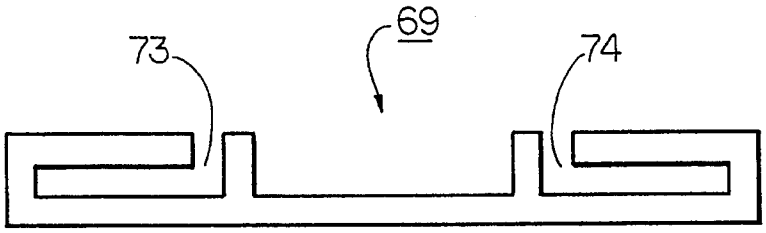
FIG. 9 is a top view of the right end member shown in FIG. 1.
Figure 10:
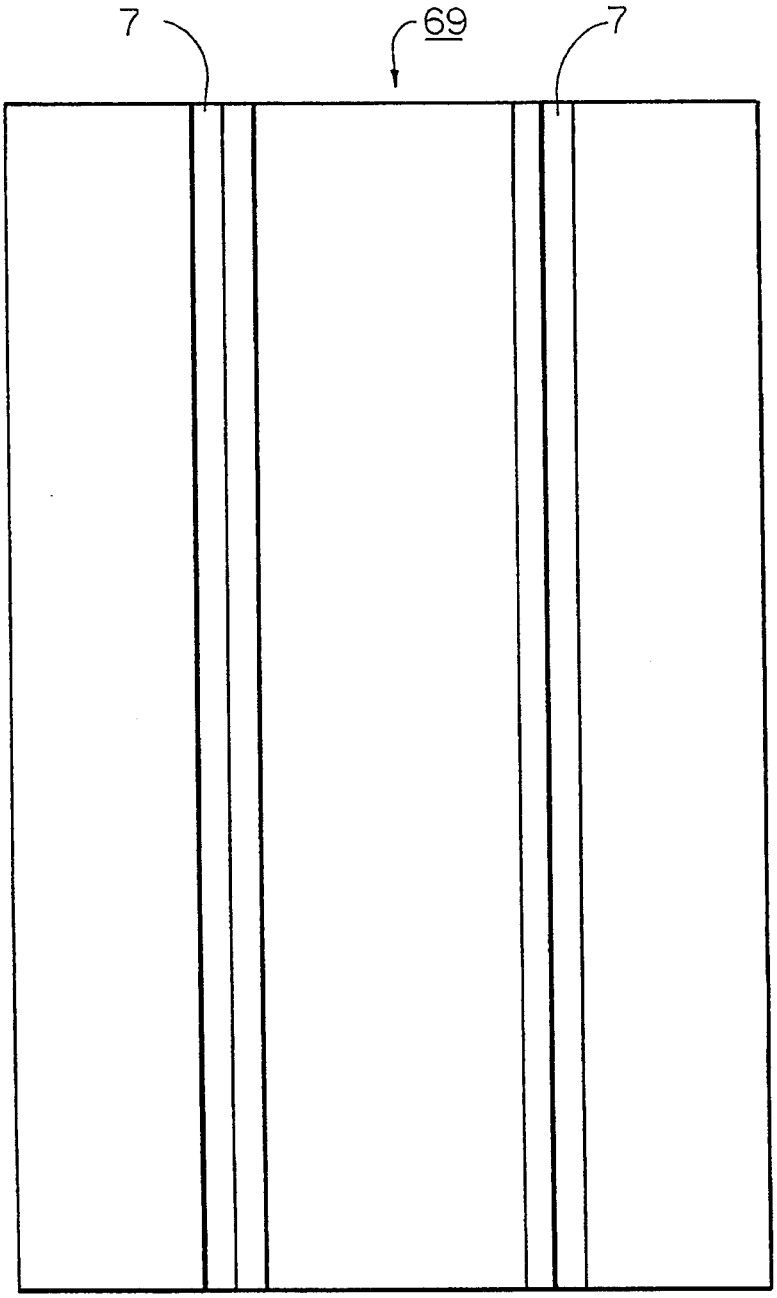
FIG. 10 is a left end view of the right end member shown in FIG. 9.

Referring back again to FIG. 1, wall structure 11 can further be seen to include a pair of right end members 69-1 and 69-2. Member 69-1 is connected to right end panel 17-2 of form 13-2 and acts as a plug to contain the flow of concrete or other filler materials out of openings 29-1 and 29-2 of panel 17-2. Member 69-2 is fixedly attached to side panel 21-2 of form 13-2 by a screw 70 or the like and is connected to right end panel 17-3 of form 13-3 so as to join forms 13-2 and 13-3 in an end-to-end fashion. Member 69 is shown separately in FIGS. 9 and 10. As can be seen, member 69 is an elongated, generally rectangular, unitary panel structure shaped to include a pair of L-shaped slots 73 and 74, slots 73 and 74 being sized and shaped to mate with L-shaped flanges 23 and 24, respectively, of form 13.

Figure 11:
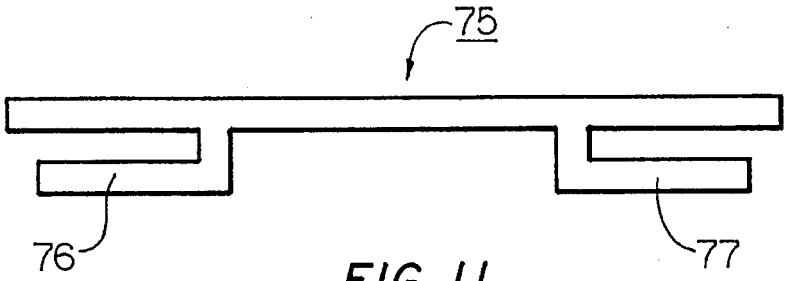
FIG. 11 is a top view of one of the left end members shown in FIG. 1.
Figure 12:
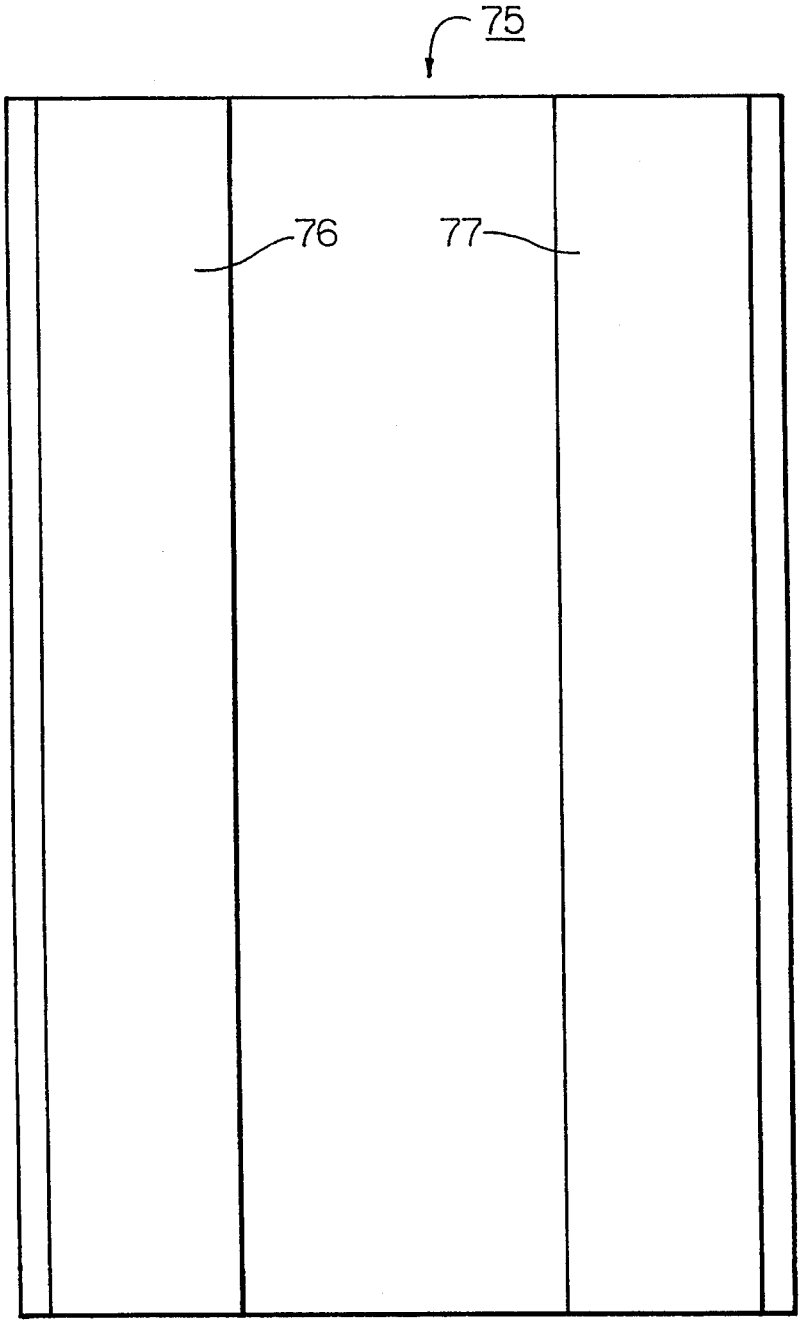
FIG. 12 is a right end view of the left end member shown in FIG. 11.

Referring back again to FIG. 1, wall structure 11 can further be seen to include a pair of left end members 75-1 and 75-2. Member 75-1 is connected to left end panel 19-1 of form 13-1 and acts as a plug to contain the flow of concrete or other filler materials out of openings 30-1 and 30-2 in panel 19-1. Member 75-2 is connected to left end panel 19-3 of form 13-3 and similarly acts as a plug to contain the flow of concrete or the like out of openings 30-1 and 30-2 in panel 19-3. An exemplary member 75 is shown separately in FIGS. 11 and 12. As can be seen, member 75 is an elongated, generally rectangular, unitary panel structure shaped to include a pair of opposed, outwardly facing, L-shaped flanges 76 and 77, which are mateable with slots 27 and 28, respectively, of form 13. As can readily be appreciated, in addition to being used as a plug, member 75 can also be fixedly attached to the side of a form 13, in the same manner as discussed above with member 69-2, for the purpose of joining together a pair of forms 13 in an end-to-end fashion.

Figure 13:
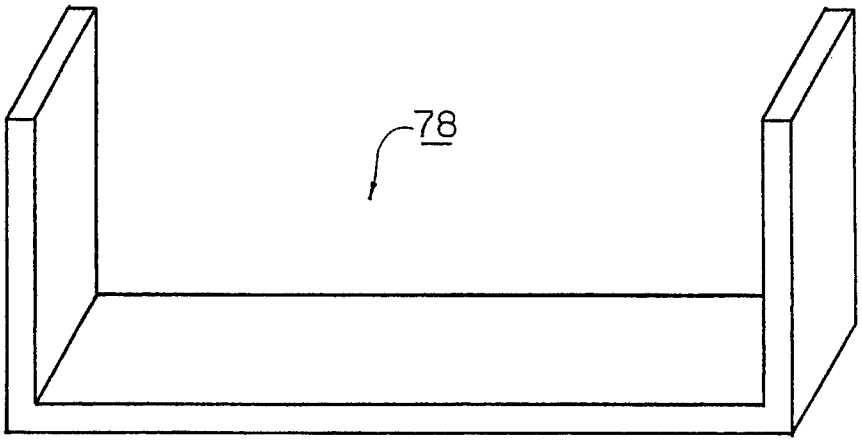
FIG. 13 is an end perspective view of one of the shoe members shown in FIG. 1.

Referring back again to FIG. 1, wall structure 11 can further be seen to include a pair of U-shaped shoes or brackets 78-1 and 78-2. Forms 13-1 and 13-2 are seated with bracket 78-1, and form 13-3 is seated within bracket 78-2. An exemplary bracket 78 is shown separately in FIG. 13. As can readily be appreciated, in those situations in which wall structure 11 is mounted directly into the ground, as opposed to being inserted into a concrete pad or other foundation, bracket 78 provides a level base upon which forms 13 may rest and serves to keep concrete and the like from falling out of the bottom of forms 13.

Forms 13, strut members 47, panel members 59, right end members 69, left end members 75, and brackets 78 are all preferably made from extrusions of polyvinyl chloride, polyurethane, or the like; however, foamed plastics, injection molded plastics, metals, and other similar materials may also be used.

As can readily be appreciated, the dimensions of the components of the above-described system may be varied to suit the particular needs of the end-user. Nevertheless, it has been found to be desirable for forms 13 to be about 12 inches long, 6 inches wide, and about 8 feet high, with the other components of the system being proportionately dimensioned. To obtain desired dimensions, the various components of the present system can either be molded to specific sizes or can be molded to a standard size and then cut down to one or more desired sizes.

By assembling the components of the above-described system in various combinations and permutations, wall structures of varying configurations can be fabricated. Dwellings and similar shelters can easily be fabricated by using the above-described system to build a wall structure of a defined area and then by attaching a simple roof to the wall structure. Such a roof could be made of tree branches, straw or the like or, alternatively, could be made in the manner described below using the components of the wall structure fabrication system of the present invention.

Figure 14:
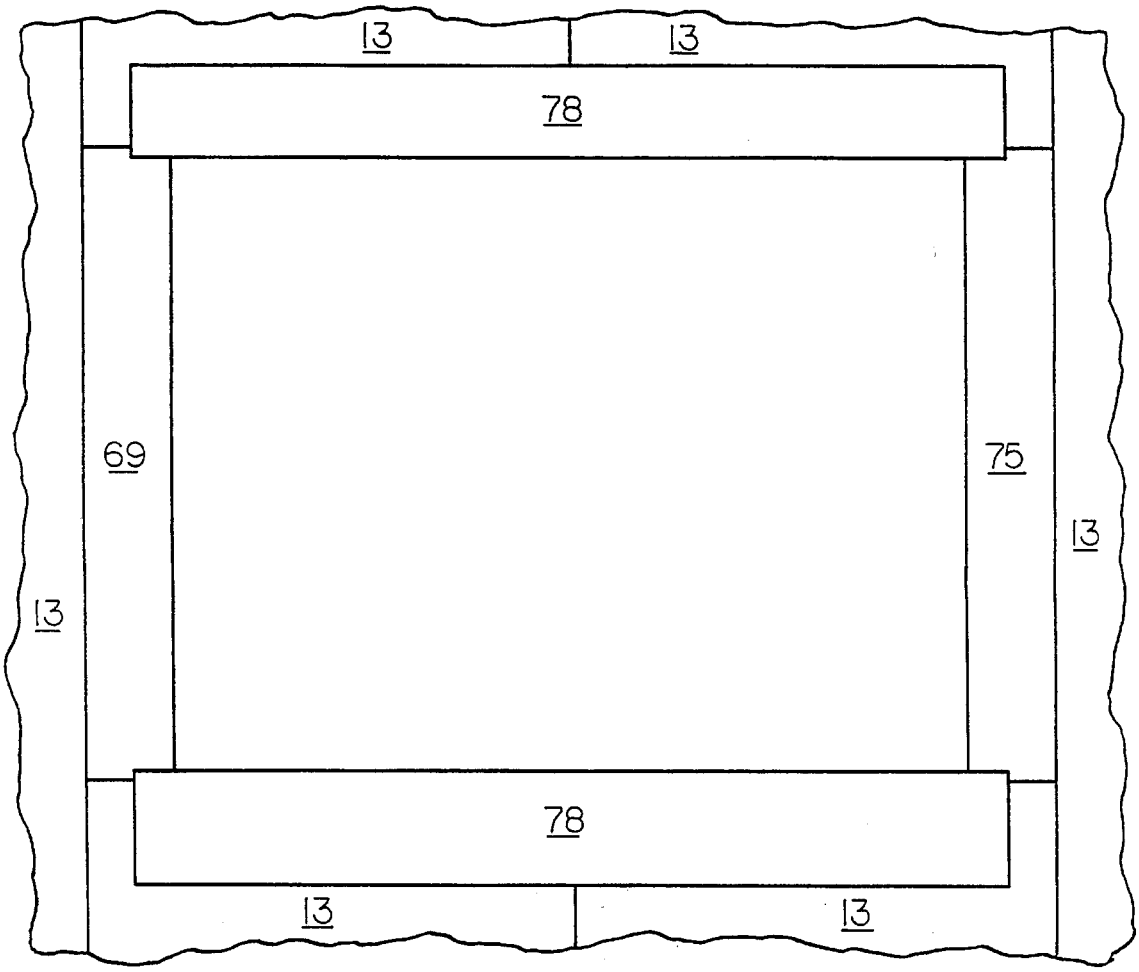
FIG. 14 is a simplified side view illustrating how certain components of the present system can be combined to construct a window frame.

In addition, spaces for windows, doors and the like can easily be incorporated into a wall structure constructed using the present invention by interconnecting one or more forms 13 that are less than full-height between a pair of full-height forms 13 and using end members 69 and 75 and brackets 78 as seen in FIG. 14.

Where the wall structure is to be used in a temperate climate, panels 59 need not be used, and concrete or the like may be restricted, using appropriate means, to those forms 13 located in the corners thereof, or to those forms 13 used to support any windows and doors incorporated thereinto. In colder climates, however, panels 59 are preferably used to define an insulation space, and concrete is preferably poured into all of the forms 13.

Figure 15:
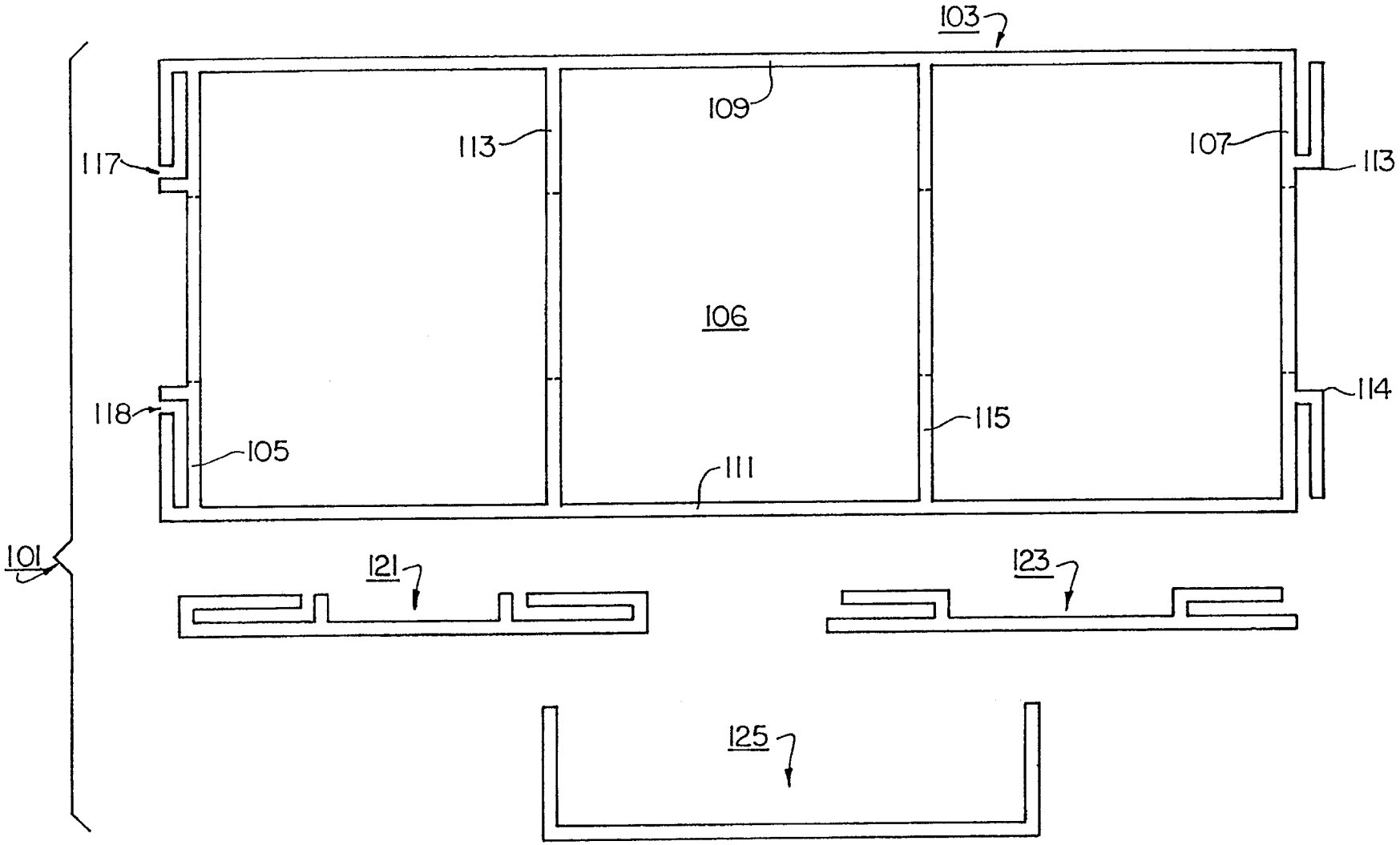
FIG. 15 is a plan view of the various types of components found in a second embodiment of a wall structure fabrication system constructed according to the teachings of the present invention.

Referring now to FIG. 15, there is shown a plan view of the various types of components of a second embodiment of a wall structure fabrication system constructed according to the teachings of the present invention, the system being represented collectively by the reference numeral 101. (It is to be understood that, while only one of each type of component of system 101 is shown in FIG. 15, system 101 may include and preferably does include several units of each component.)

As can be seen, one of the types of components of system 101 is a prefabricated form 103. Form 103, which is generally similar in size, shape and construction to prefabricated form 13, is an elongated, generally rectangular, unitary structure which includes a left end panel 105, a right end panel 107, a pair of side panels 109 and 111, and a pair of supporting strut panels 113 and 115. Left end panel 105, right end panel 107 and side panels 109 and 111 together form a hollow cavity 106 adapted to receive concrete, sand, mud, gravel, or other similar materials. The outer surface of right end panel 107 is shaped to include a pair of opposed, outwardly facing, L-shaped flanges 113 and 114, and the outer surface of left end panel 105 is shaped to include a pair of L-shaped slots 117 and 118. Slots 117 and 118 are sized and shaped to mate with flanges 113 and 114, respectively, so that a pair of forms 103 may be interconnected in an end-to-end relationship by inserting flanges 113 and 114 of one form 103 into slots 117 and 118, respectively, of a second form 103.

Left end panel 105, right end panel 107 and supporting strut panels 113 and 115 are each provided with at least one circular hole (represented in FIG. 15 by dotted lines on left end panel 105, right end panel 107 and supporting strut panels 113 and 115). The respective circular holes in left end panel 105, right end panel 107 and strut panels 113 and 115 are aligned with one another to accommodate the placement of horizontal reinforcement bars through adjacent forms 103 and to permit concrete and other similar materials to be distributed monolithically between adjacent forms.

As can be seen, system 101 also includes a right end member 121, a left end member 123 and a U-shaped bracket 125. Right end member 12 1, left end member 123 and bracket 125 are the same in size, shape and construction to the above-described right end member 69, left end member 75 and bracket 78 and may be used in the same manner thereto, in combination with forms 103, to construct wall structures.

Figure 16:
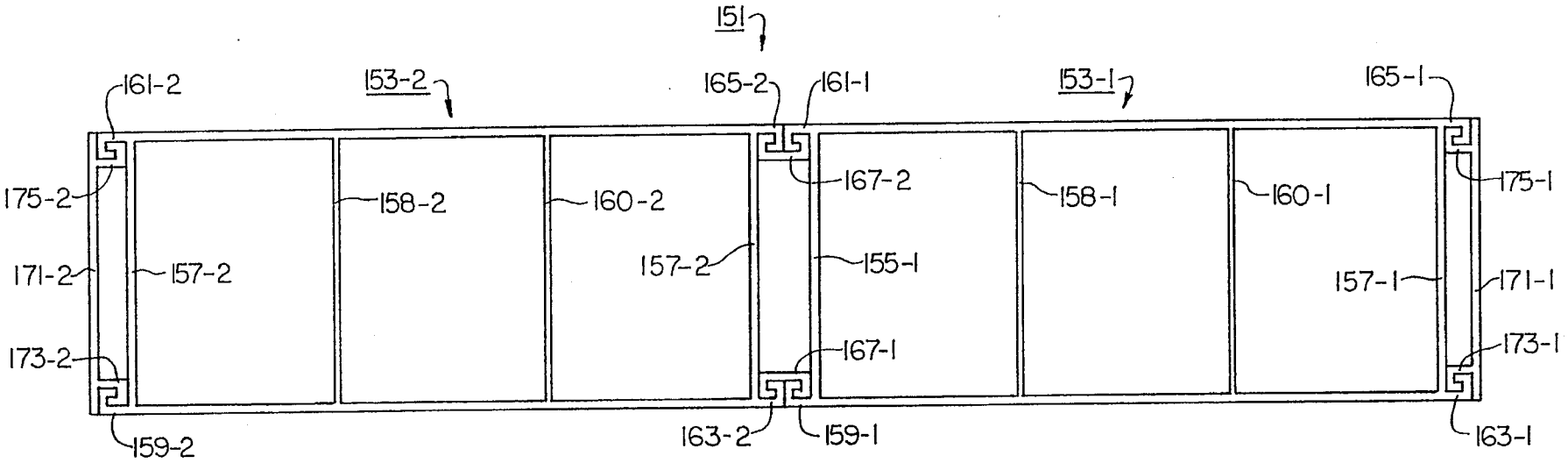
FIG. 16 is a top view of a simple wall structure fabricated using some of the components of a third embodiment of a wall structure fabrication system of the present invention.

Referring now to FIG. 16, there is shown a top view of a simple wall structure constructed using selected components of a third embodiment of the wall structure fabrication system of the present invention, the wall structure being represented generally by reference numeral 151 (the particular wall structure being shown for illustrative purposes only).

Figure 17:
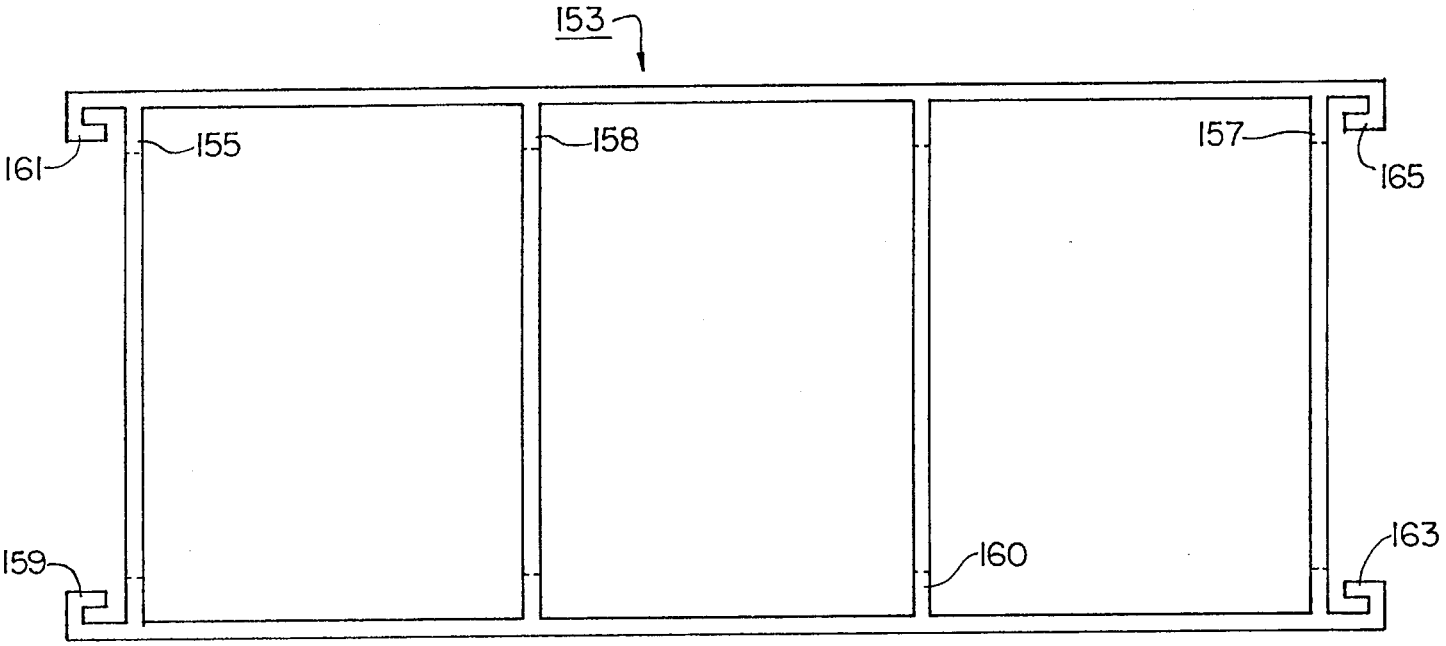
FIG. 17 is an enlarged top view of one of the prefabricated forms shown in FIG. 16.

Wall structure 151 comprises a pair of identical prefabricated forms 153-1 and 153-2. An exemplary form 153 is also shown separately in FIG. 17. Form 153 is similar in every respect to form 103 described above, except that left and right panels 155 and 157 of form 153 are shaped to each include a pair of opposed, inwardly-facing hooks. Hooks 159 and 161 are formed on left panel 155, and hooks 163 and 165 are formed on right panel 157. Left panel 155, right panel 157 and supporting strut panels 158 and 160 are all provided with alignable circular holes (represented in FIG. 17 by dotted lines).

Figure 18:
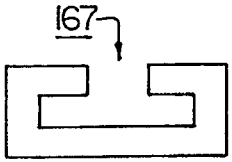
FIG. 18 is an enlarged top view of one of the locking strips shown in FIG. 16.

Wall structure 151 also includes a pair of locking strips 167-1 and 167-2. An individual locking strip 167 is shown separately in FIG. 18. As can be seen, strips 167-1 and 167-2 may be used to join together forms 153-1 and 153-2 by fitting strip 167-1 over hooks 159-1 and 163-2 and by fitting strip 167-2 over hooks 161-1 and 165-2.

Figure 19:
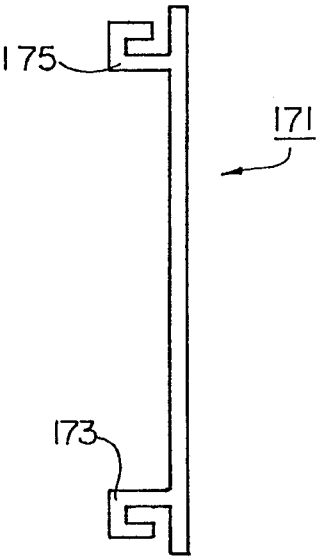
FIG. 19 is an enlarged top view of one of the end members shown in FIG. 16.

Wall structure 151 further includes a pair of identical end members 171-1 and 171-2. An individual end member 171 is shown separately in FIG. 19. End members 171, which are shaped to include hooks 173 and 175 interlockable with the hooks on either the left or right panels of forms 153-2 and 153-1, respectively, perform the same function as end members 69 and 75 described-above. One advantage to the symmetric arrangement of hooks on left and right panels of form 153, however, is that end member 171 can be attached to either the left or right panel thereof, thereby reducing the number of different components required in the system.

Although not shown in FIG. 16, wall structure 15 1 could include one or more U-shaped brackets 78 used in any of the ways described above.

Figure 20:
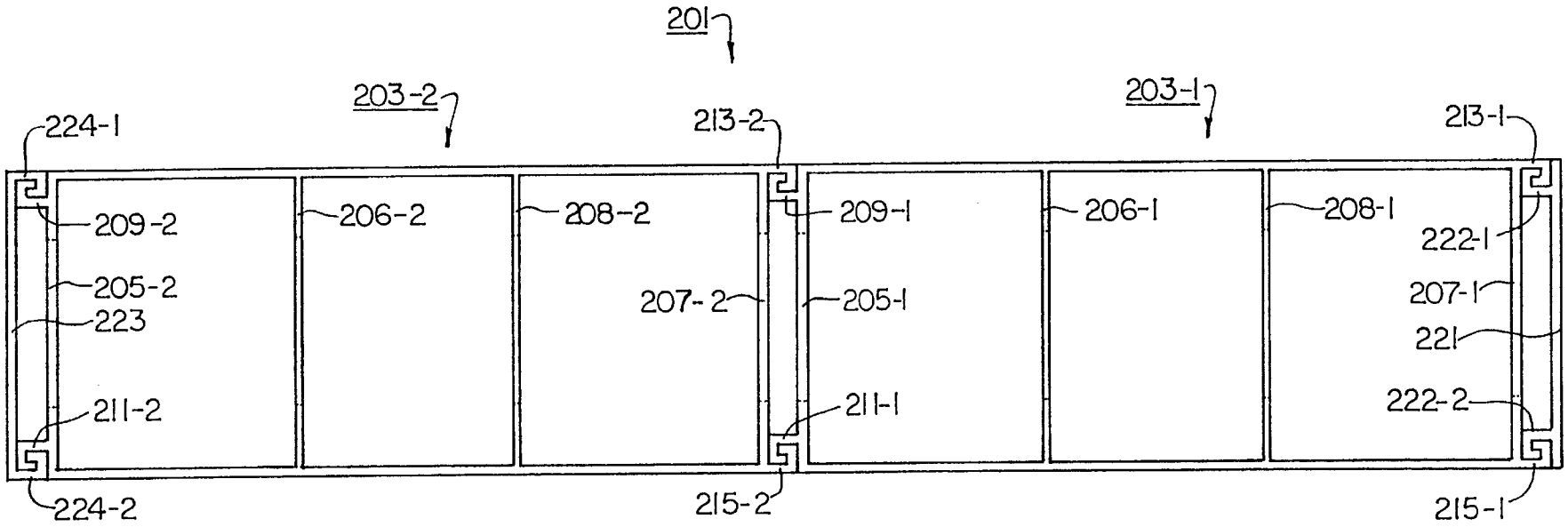
FIG. 20 is a top view of a simple wall structure fabricated using some of the components of a fourth embodiment of a wall structure fabrication system of the present invention.

Referring now to FIG. 20, there is shown a top view of a simple wall structure constructed using selected components of a fourth embodiment of the wall structure fabrication system of the present invention, the wall structure being represented generally by reference numeral 201 (the particular wall structure being shown for illustrative purposes only).

Wall structure 201 comprises a pair of identical prefabricated forms 203-1 and 203-2. Form 203 is similar in every respect to form 153 described above, except that the left and right panels 205 and 207, respectively, of form 203 are each shaped to include a pair of hooks, left panel 205 having a pair of opposed, outwardly-facing hooks 209 and 211 and right panel 207 having a pair of opposed, inwardly-facing hooks 213 and 215. Forms 203-1 and 203-2 are joined together by interlocking hooks 209-1 and 211-1 of form 203-1 with hooks 213-2 and 215-2, respectively, of form 203-2. Left panel 205, right panel 207 and supporting strut panels 206 and 208 are all provided with alignable circular holes (represented in FIG. 20 by dotted lines).

Wall structure 201 also includes a right end member 221 and a left end member 223. Right end member 221, which performs the same function as right end member 121, includes a pair of opposed, outwardly-facing hooks 222-1 and 222-2 interlockable with hooks 213 and 215, respectively, of form 203. Left end member 223, which performs the same function as left end member 123, is shaped to include a pair of opposed, inwardly-facing hooks 224-1 and 224-2 interlockable with hooks 209 and 211, respectively.

Although not shown, wall structure 201 could include one or more U-shaped brackets 78 for the purposes described above.

Figure 21:
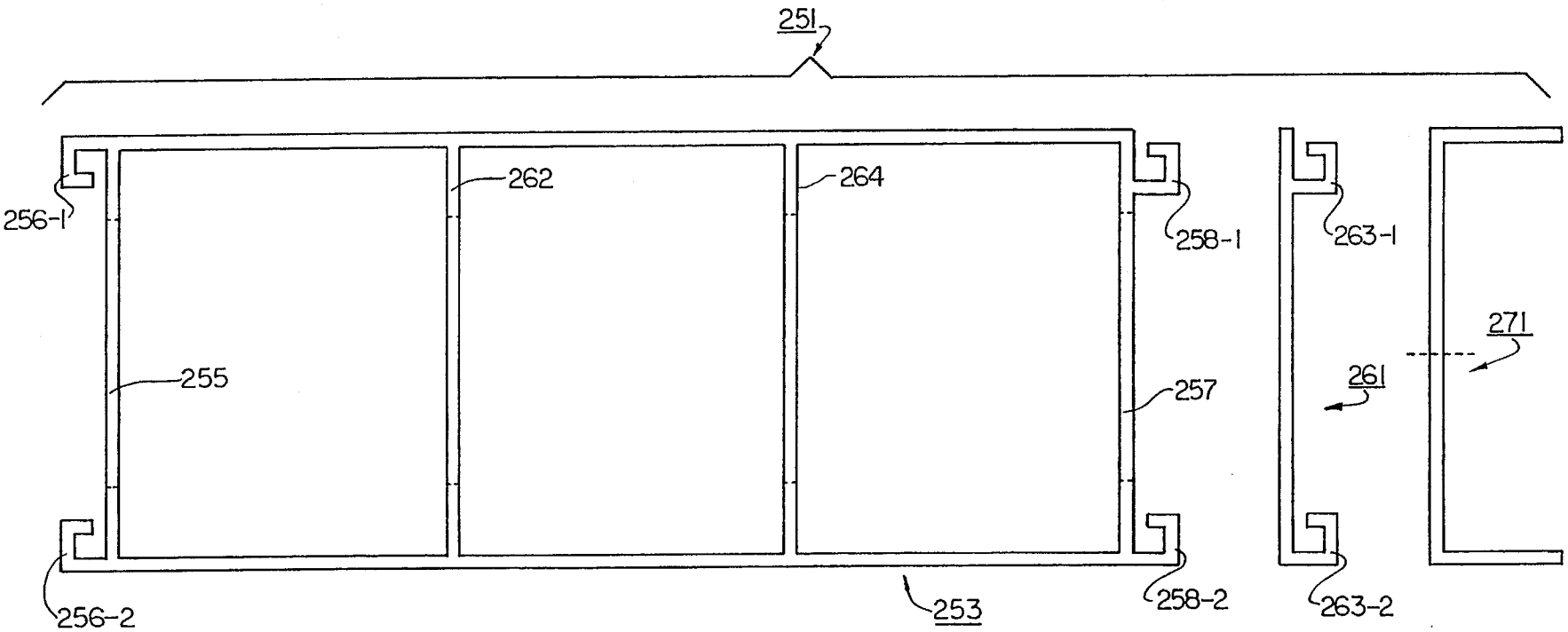
FIG. 21 is a plan view of two of the primary components (the U-shaped bracket not being shown) found in a fifth embodiment of a wall structure fabrication system constructed according to the teachings of the present invention.

Referring now to FIG. 21, there is shown a plan view of selected components of a fifth embodiment of a wall structure fabrication system constructed according to the teachings of the present invention, the system being represented collectively by reference numeral 25 1. (It is to be understood that, while only one of each selected component of system 25 1 is shown in FIG. 21, system 251 may include and preferably does include several units of each component.)

As can be seen, one of the types of components of system 251 is a prefabricated form 253. Form 253 is similar in every respect to form 203 described above, except that left panel 255 is shaped to include a pair of hooks 256-1 and 256-2 both facing in the direction of one side panel and right panel 257 is shaped to include a pair of hooks 258-1 and 258-2 both facing in the direction of the opposite side panel. A pair of forms 253 may be joined together by interlocking hocks 209-1 and 211-1 of form 203-1 with hooks 213-2 and 215-2, respectively, of form 203-2. Left panel 255, right panel 257 and supporting strut panels 262 and 264 are all provided with alignable circular holes (represented in FIG. 21 by dotted lines).

Another type of component included in system 25 1 is an end member 261. End member 261, which is shaped to include a pair of similarly facing hooks 263-1 and 263-2 interlockable with the hooks on either the left or right panels of form 253, performs the same function as do end members 69 and 75 described-above. However, because left and right panels of form 253 are symmetric about their respective midpoints, end member 261 can be attached to either the left or right panel thereof, thereby reducing the number of different components required in the system.

Still another type of component included in system 251 is a bracket 271. Bracket 271 is identical in size, shape and construction to bracket 125 and may be used in the same ways.

As has been alluded to above and as will hereinafter be described, any of the embodiments of the wall structure fabrication system of the present invention can be used to fabricate a roofed structure, such as dwelling.

Figure 22:
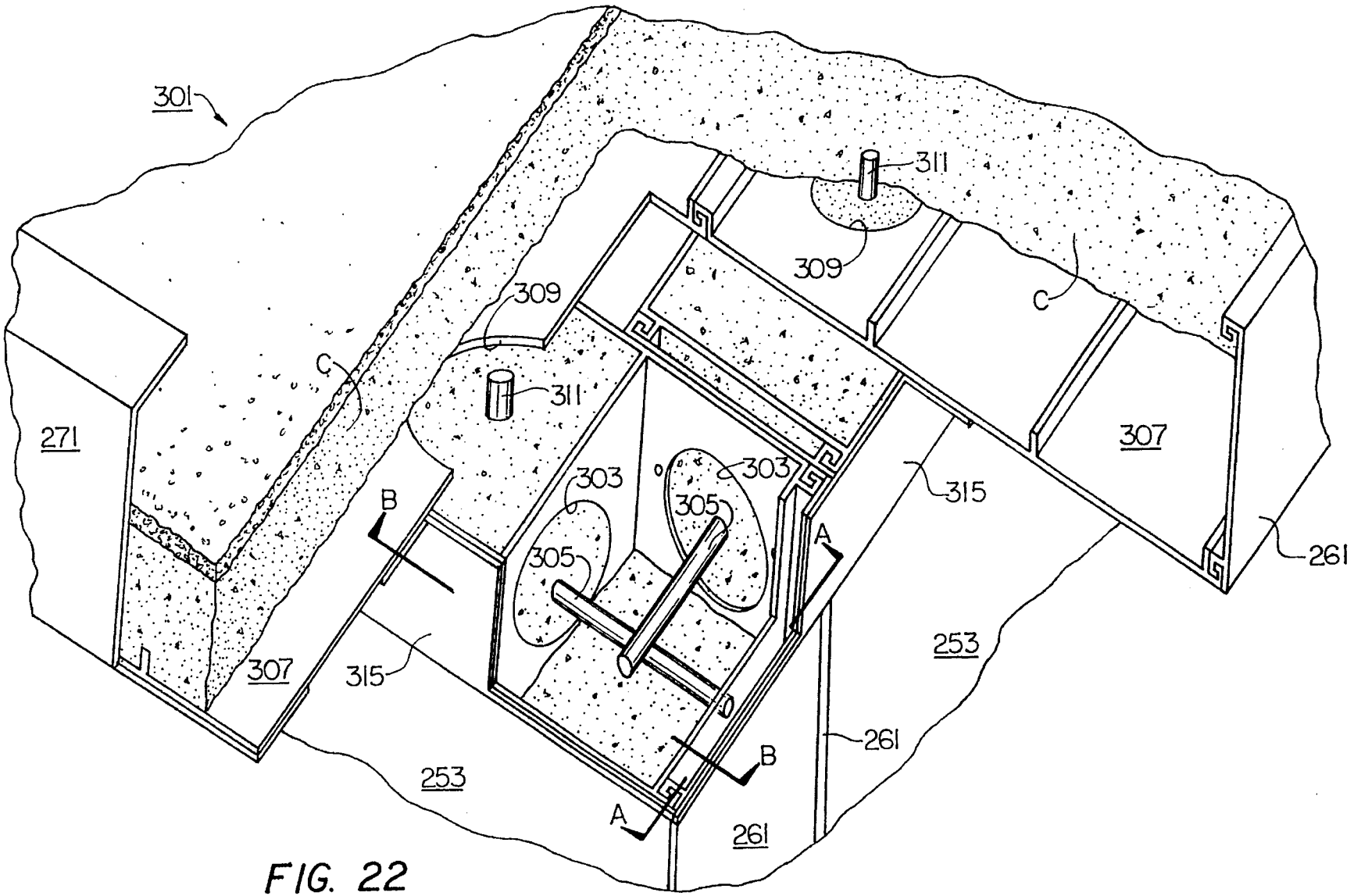
FIG. 22 is a fragmentary perspective view, cut away along various vertical planes, of a roofed structure fabricated using one embodiment of the wall structure fabrication system of the present invention.
Figure 23:
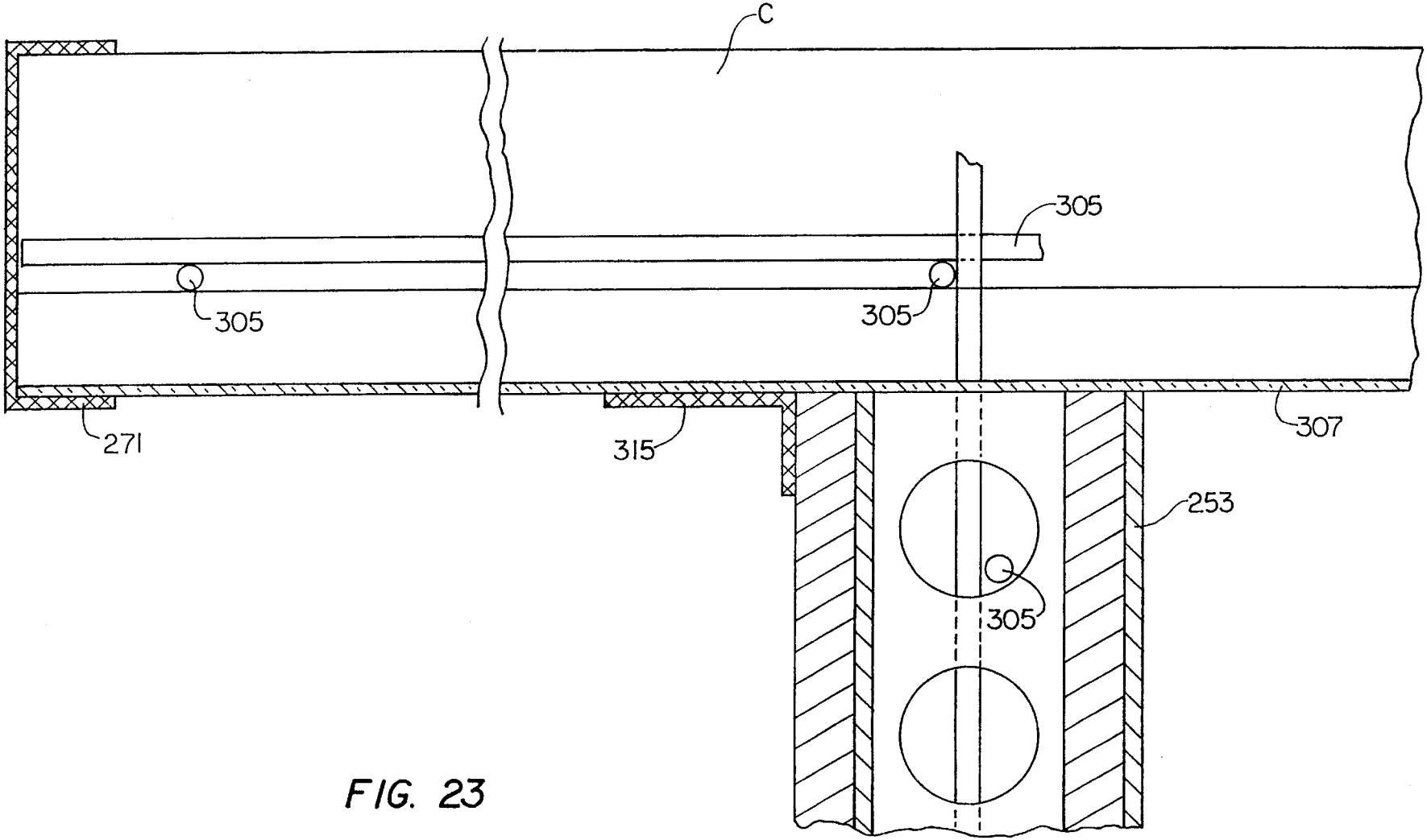
FIG. 23 is a simplified section view of the roofed structure shown in FIG. 22 taken along line A—A.
Figure 24:
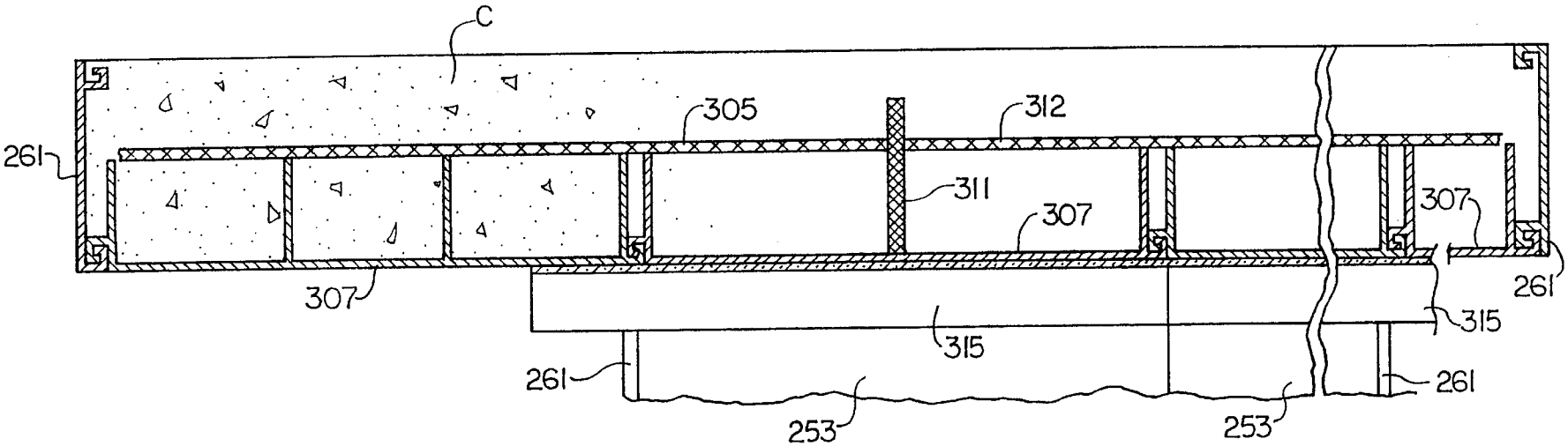
FIG. 24 is a simplified section view of the roofed structure shown in FIG. 22 taken along line B—B.

Referring now to FIGS. 22 through 24, there are shown various views of an exemplary roofed structure fabricated according to the teachings of the present invention and using wall structure fabrication system 251, the roofed structure being represented generally by reference numeral 301.

One possible way to make roofed structure 301 is as follows: First, forms 257 and end members 261 are joined together and inserted into the ground (or into a concrete pad, one or more brackets 271 previously inserted into the ground or the like) in such a way as to create a walled area of desired dimensions. Next, structural reinforcement bars 305 are inserted horizontally through openings 303 provided in the forms 257 of the walled structure. A plurality of roof forms 307, each of which has been prepared by cutting a form 257 longitudinally in a plane parallel to its side panels, are then joined together and placed across the top surfaces of the wall forms 257 to form a roof. A roof overhang of approximately 2 feet has been found to be acceptable. Openings 309 are preferably made in the bottom surfaces of roof forms 307 so that vertical reinforcement bars 311 and concrete may be inserted therethrough into the wall forms 257 below. (Horizontal reinforcement bars 305 may also be arranged in the roof forms 307.) A pair of end members 261 are joined to the respective ends of the roof defined by the plurality of interconnected roof forms 307, and a pair of brackets 27 1 are mounted onto the respective sides of the roof. As seen best by FIGS. 23 and 24, the combination of the plurality of roof forms 307, end members 261 and brackets 271 jointly define a trough-like structure into which concrete or the like may be poured. Prior to the addition of concrete or the like theminto, however, it is preferable to provide a roof seal molding. This may be done by cutting a plurality of brackets 271 in half (as indicated by the dotted lines in FIG. 21) and mounting the resultant L-shaped brackets 315 at the inside and outside junctures of the wall forms 253 and the roof forms 307. Concrete C or the like is then poured into the roof until both the wall forms 253 and roof forms 307 are filled therewith and then allowed to harden.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A prefabricated form for use in fabricating a wall structure, said prefabricated form comprising an elongated hollow member shaped to include a left end panel, a right end panel, and a pair of side panels, said left end panel and said right end panel being interconnectable in an end-to-end fashion, said left end panel and said right end panel each having a hole formed therein so that, when a pair of said prefabricated forms are interconnected in an end-to-end fashion by interconnecting the left end panel of one of said forms with the right end panel of the other of said forms and concrete is poured into at least one of said prefabricated forms, a monolithic concrete structure may be formed between the pair of adjacent prefabricated forms.

2. The prefabricated form as claimed in claim 1 wherein said elongated hollow member is also shaped to include one or more supporting strut panels extending between said pair of side panels, each of said one or more supporting strut panels having a hole formed therein for use in forming a monolithic concrete structure.

3. The prefabricated form as claimed in claim 1 wherein said left end panel is shaped to include a first hook and a second hook, said first hook and said second hook being opposed and inwardly-facing and wherein said right end panel is shaped to include a third hook and a fourth hook, said third hook and said fourth hook being opposed, inwardly-facing and alignable with said first hook and said second hook, respectively, so that said first hook and said third hook may be interconnected with a first locking strip and said second hook and said fourth hook may be interconnected with a second locking strip.

4. The prefabricated form as claimed in claim 1 wherein said left end panel and said right end panel are matingly engageable so that a pair of said prefabricated forms may be interconnected in an end-to-end fashion by interlocking the left end panel of one of said forms with the right end panel of the other of said forms.

5. The prefabricated form as claimed in claim 4 wherein said right end panel is shaped to include a pair of L-shaped flanges and wherein said left end panel is shaped to include a pair of L-shaped slots mateable with said pair of L-shaped flanges.

6. The prefabricated form as claimed in claim 4 wherein said right end panel is shaped to include a first hook and a second hook, said first hook and said second hook being opposed and inwardly-facing and wherein said left end panel is shaped to include a third hook and a fourth hook, said third hook and said fourth hook being opposed, outwardly-facing and mateable with said first and second hooks, respectively.

7. The prefabricated form as claimed in claim 4 wherein said right end panel is shaped to include a first hook and a second hook, said first hook and said second hook facing towards one of said side panels and wherein said left end panel is shaped to include a third hook and a fourth hook facing towards the other of said side panels and being mateable with said first and second hooks, respectively.

8. The prefabricated form as claimed in claim 1 wherein said holes in said left end panel and said right end panel are circularly-shaped.

9. The prefabricated form as claimed in claim 1 wherein said elongated hollow member is made from extruded plastic.

10. A wall structure fabrication system comprising a pair of identical forms, each of said pair of identical forms comprising an elongated hollow member extruded from plastic and shaped to include a left end panel, a right end panel, and a pair of side panels, said left end panel and said right end panel being matingly engageable so that said pair of said prefabricated forms may be interconnected in an end-to-end fashion by interlocking the left end panel of one of said forms with the right end panel of the other of said forms, said left end panel and said right end panel each having a hole formed therein so that, when said pair of said prefabricated forms are interconnected in an end-to-end fashion by mating the left end panel of one of said forms with the right end panel of the other of said forms and concrete is poured into at least one of said prefabricated forms, a monolithic concrete structure may be formed between said pair of adjacent prefabricated forms.

11. The wall structure fabrication system as claimed in claim 10 wherein said right end panel is shaped to include a first hook and a second hook, said first hook and said second hook facing towards one of said side panels and wherein said left end panel is shaped to include a third hook and a fourth hook facing towards the other of said side panels and being mateable with said first and second hooks, respectively.

12. The wall structure fabrication system as claimed in claim 11 further comprising at least one end member, said end member being matingly engageable with either said left end panel or said right end panel of said prefabricated forms and being appropriately shaped to contain concrete which has passed through the hole in the end panel to which it is attached.

13. The wall structure fabrication system as claimed in claim 12 further comprising a U-shaped bracket appropriately dimensioned to fit over one of said prefabricated forms across its width.

14. The wall structure fabrication system as claimed in claim 12 wherein said holes are circularly-shaped.

15. A wall structure fabrication system comprising:

a) a pair of identical forms, each of said forms comprising an elongated hollow member shaped to include a left end panel, a right end panel and a pair of side panels, said left end panel and said right end panel being mirror images of one another and each having a pair of hooks extending outwardly therefrom and each having a hole formed therein so that, when said pair of said prefabricated forms are interconnected in an end-to-end fashion and concrete is poured into at least one of said prefabricated forms, a monolithic concrete structure may be formed between said pair of adjacent prefabricated forms; and b) means for interconnecting said pair of prefabricated forms in an end-to-end fashion, said means comprising a locking strip shaped to fit around one of the hooks on the left end panel of one of said prefabricated forms and the corresponding hook on the right end panel of the other of said prefabricated forms.

16. The wall structure fabrication system as claimed in claim 15 further comprising a pair of identical end members, said end members being matingly engageable on either the left end panel or right end panel of said prefabricated form and being appropriately shaped to contain the flow of concrete through the panel of the prefabricated form to which it is attached.

17. A roofed structure fabrication kit comprising:

a) a plurality of prefabricated wall forms, each of said wall forms being an elongated hollow member shaped to include a left end panel, a right end panel and a pair of side panels, said left end panel and said right end panel being shaped to include one or more holes and one or more elements adapted for use in joining together adjacent wall forms;

b) a plurality of prefabricated roof forms, each of said roof forms being an elongated member shaped to include a left end panel, a right end panel and a side panel interconnecting said left end panel and said right end panel, c) a plurality of wall form right end members connectable to the right end panels of said wall forms;

d) a plurality of wall form left end members connectable to the left end panels of said wall forms;

e) a plurality of roof form right end members connectable to the right end panels of said roof forms;

f) a plurality of roof form left end members connectable to the left end panels of said roof forms;

g) a plurality of U-shaped wall form brackets shaped to fit over the width of said wall forms: and h) a plurality of U-shaped roof form brackets shaped to fit over the width of said roof forms.

18. The roofed structure fabrication kit as claimed in claim 17 wherein said roof forms are constructed by cutting said wall forms longitudinally in a plane parallel to their side panels and wherein said U-shaped roof form brackets and said U-shaped wall form brackets are identical.

19. The roofed structure fabrication kit as claimed in claim 18 wherein the left and right end panels of said roof forms and said wall forms are matingly engageable.

20. The roofed structure fabrication kit as claimed in claim 19 wherein the left and right end panels of said wall forms are symmetric about their respective midpoints and wherein said wall form right end members, said wall form left end members, said roof form right end members and said roof form left end members are identical.

* * * * *